United States Patent [19]

Van Bogaert et al.

[11] Patent Number: 4,869,297

[45] Date of Patent: Sep. 26, 1989

[54] DEVICE FOR FORMING A SELVEDGE OR SELVEDGES ON WOVEN CLOTH

[75] Inventors: Philippe Van Bogaert, Schaarbeek; Serge Vanrobaeys, Ieper, both of Belgium

[73] Assignee: Picanol N.V., Ieper, Belgium

[21] Appl. No.: 168,419

[22] Filed: Mar. 15, 1988

[30] Foreign Application Priority Data

Mar. 30, 1987 [BE] Belgium ..... 8700324

[51] Int. Cl.[4] ..... D03D 47/40

[52] U.S. Cl. ..... 139/54

[58] Field of Search ..... 139/54

[56] References Cited

U.S. PATENT DOCUMENTS 3,741,256 6/1973 Wesseler ..... 139/54
4,108,213 8/1978 Guttinger .

FOREIGN PATENT DOCUMENTS 1816407 8/1969 Fed. Rep. of Germany .
2329302 6/1973 Fed. Rep. of Germany .
8208089 8/1982 Fed. Rep. of Germany .
3108662 9/1982 Fed. Rep. of Germany ..... 139/54
8316232 12/1983 Fed. Rep. of Germany .
1137356 5/1957 France .
564114 7/1975 Switzerland .
917634 2/1963 United Kingdom .

*Primary Examiner*—Henry S. Jaudon
*Attorney, Agent, or Firm*—Bacon & Thomas

[57] ABSTRACT

Device for forming a selvedge or selvedges on woven cloth, consisting essentially of two arms (1, 2) whose ends move to-and-fro in opposite directions, where the first arm (1) has at its end (3) a rotatable thread guide block (5) for the crossing thread or threads, and where the second arm (2) has at least one needle-shaped thread guide (6, 6A, 6B) for the needle thread or threads (27, 27A, 27B) so that the needle thread or threads can be moved up and down in front of the rotatable thread guide block (5) as a result of the motion of the arms (1, 2).

10 Claims, 7 Drawing Sheets

5
6A
6B
27A
27B
16A
17B
38
17A
16B
39

26B
26A
6A
6B
14B
15B
5
15A
14A
17B
16B
27A
27B
F19
16A
17A
39
34A
38

1
2
3
4
15B
5
15A
26B
6B
14B
26A
6A
14A
17B
16B
27A
27B
16A
17A
39
38

DEVICE FOR FORMING A SELVEDGE OR SELVEDGES ON WOVEN CLOTH

BACKGROUND OF THE INVENTION

1. Field of the Invention

This invention concerns a device for forming a selvedge or selvedges on cloths, ie. a device for use on weaving machines in order to make at least one selvedge during the weaving process. In particular, this invention concerns a device for forming at least one selvedge using one needle thread and up to two crossing threads per selvedge.

2. Discussion of Related Information

Techniques for forming a selvedge on cloth are common technology, and various selvedge-forming devices are known. German utility model No. 8316232 describes a selvedge-forming device in which the motion of the various parts is controlled by the motion of the lead frames or harnesses. Such devices have the disadvantage that the operating cycle of the selvedge-forming device cannot be set independently, but is determined by the motion of particular harnesses. The vibration of the harnesses has a detrimental effect on the operation of the device, due to the wear and consequent danger of breakage.

Swiss patent No. 564.114 describes a device for forming a selvedge using mechanical pushers to impart the necessary motion. However this type of device has the disadvantage that it is not suitable for high weaving speeds, due to the effects of wear and the danger of breakage.

German utility model No. 8208089 describes a method of controlling the movement of the crossing threads via the motion of a slide block with thread guide openings in the form of slanting slits. However, since there is no positive control of the crossing thread motion there cannot be absolute certainty as to the position of the crossing threads.

Various other selvedge-forming devices are known whose main disadvantage is their complicated mechanical construction. An example of such a device is found in German patent No. 1.816.407.

BRIEF SUMMARY OF THE INVENTION

The present invention concerns a device for forming the selvedge on a cloth which does not have any of these disadvantages. The device according to the invention is simple in construction, operates independently of the reed and harness motions and is fixed independently on the machine.

A particular advantage of the device according to the invention is that the shed formed by the selvedge threads, ie. by the needle thread and the crossing threads, is no greater than the normal shed height. This enables the reed height (and therefore the mass of the reed) to be kept low, which is important on high-speed machines.

The small shed height also keeps the stress in the selvedge threads lower than in other devices known so far, thus reducing selvedge thread breakages.

The selvedge-forming device according to the invention consists essentially of two arms whose ends move to-and-fro in opposite directions, where the first arm has a rotatable thread guide block with at least one set of thread guide openings, and the second has at least one needle-shaped thread guide which has at least one thread guide opening and which reciprocates in front of the rotatable thread guide block, together with a drive mechanism to control the motion of the rotatable thread guide block, and another separate and independently controllable drive mechanism to control the motion of the arms.

BRIEF DESCRIPTION OF THE DRAWINGS

For the purpose of describing the characteristics of the invention, the following two preferred embodiments are described with reference to the accompanying drawings, by way of example only and without being limitative in any way, where:

FIG. 19 is a view in the direction of arrow F19 in FIG. 18.

DETAILED DESCRIPTION OF THE PREFERRED EMBODIMENTS

Figure 1:
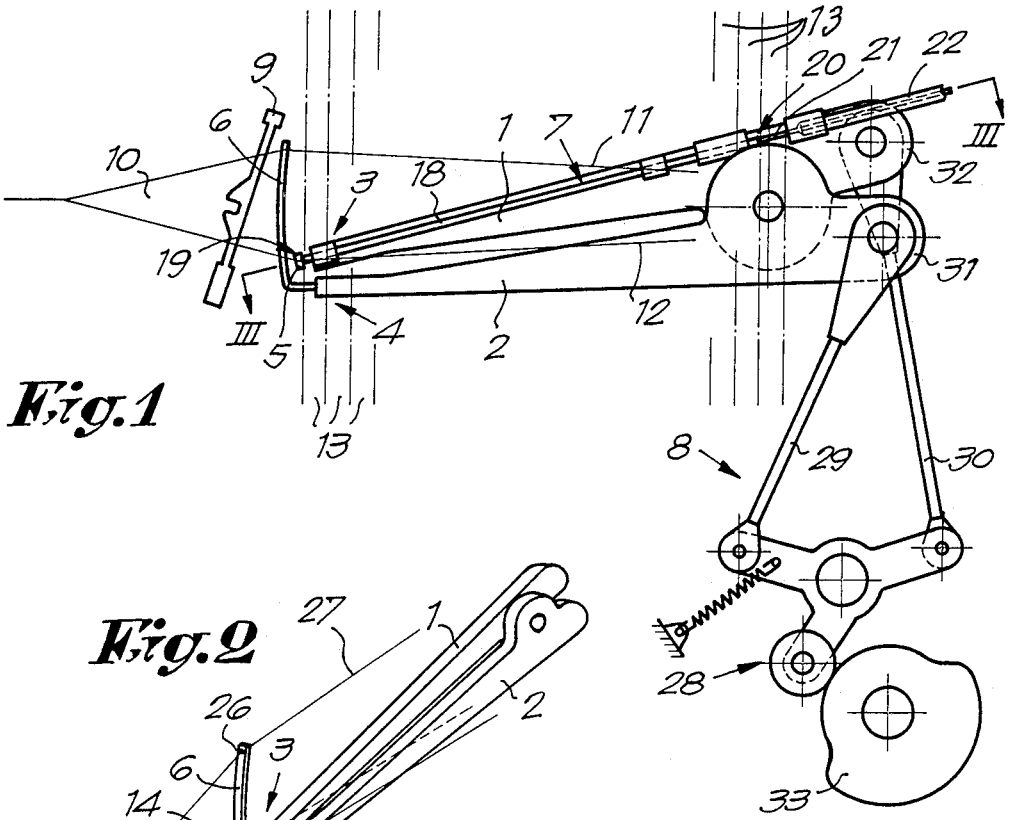
FIG. 1 shows the device according to the invention, for forming one selvedge.

In the embodiment shown in FIG. 1, the device according to the invention consists essentially of two elongated support arms 1 and 2, whose ends 3 and 4 repeatedly reciprocate in opposite directions towards and away from each other (in this case vertically up and down). One of the ends carries a rotatable thread guide block 5, and the other carries a needle-shaped thread guide 6. The device also incorporates a first drive mechanism 7 arranged to control the rotational motion of the rotatable thread guide block 5, and another separate, independently controllable drive mechanism to control the reciprocating motion of the arms 1 and 2.

FIG. 1 also shows how the device according to the invention is situate with respect to some of the normal weaving machine components, namely the reed 9, the shed 10 with the upper shed 11 and the lower shed 12, and the harnesses 13 (the last-named are only shown schematically).

Figure 2:
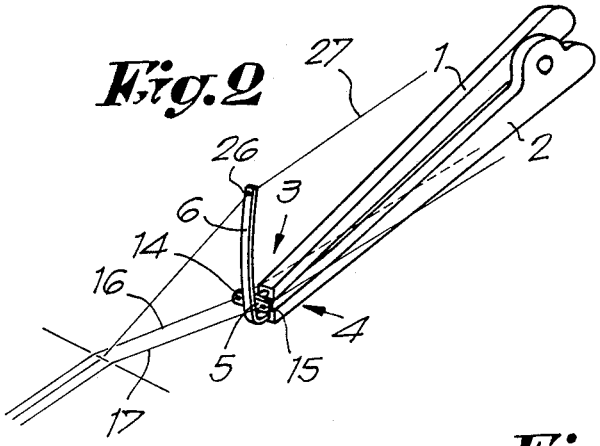
FIG. 2 is a perspective drawing of the moving arms shown in FIG. 1.

As shown in FIG. 2, the rotatable thread guide block 5 consists of eg. a rectangular block attached in the center by a pivot-mounting in such a way that it can rotate in a plane perpendicular to the longitudinal axis of arm 1. This thread guide block 5 has two thread guide openings 14 and 15 situated opposite each other and laterally of the pivot mounting, through which the selvedge threads 16 and 17 are guided.

Figure 3:
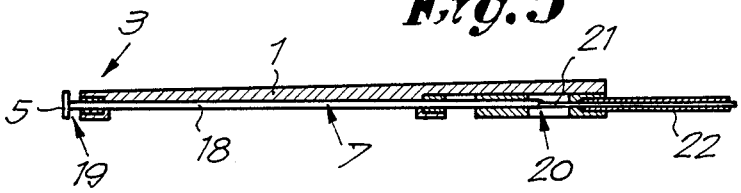
FIG. 3 is a cross-section along the line III—III in FIG. 1.
Figure 4:
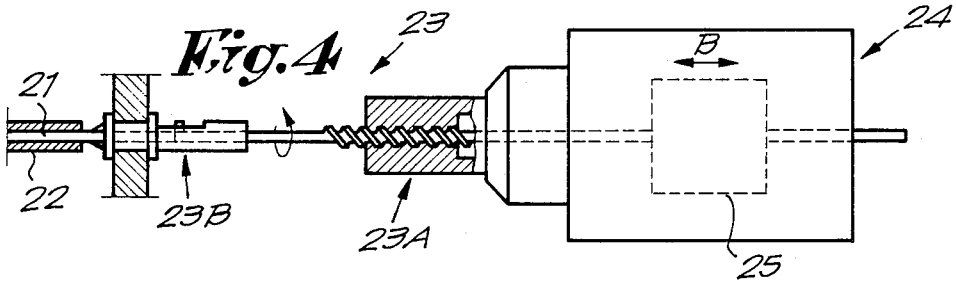
FIG. 4 shows the drive mechanism of the rotatable thread guide block.

The drive mechanism 7 which controls the rotation of the thread guide block 5 is shown in more detail in FIGS. 3 and 4. As can be seen in FIG. 3, in or along the first arm 1 there is a rod-shaped part 18 on whose end 19 the rotatable thread guide block is fixed. At its other end 20 the rod-shaped part 18 is attached to a cable drive 21 which is coupled via a suitable conduit 22 to a motion converter 23 which transforms the linear motion imparted by solenoid 24 into a rotary motion. The rod 18 and cable drive 21 thus together form a transmission mechanism. The converter 23 and solenoid 24 are shown in FIG. 4. The armature 25 of the solenoid 24 follows a reciprocating, linear motion in the direction of arrow B. The converter 23 which converts this linear motion into a rotary motion consists essentially of a screw mechanism 23A and a coupling device 23B, as shown in FIG. 4.

The armature 25 is moved by electromotive force in one direction, and is moved back in the other direction by a return spring (not shown). The drive mechanism 7, and more particularly the displacement mechanism 24, should preferably be constructed so that the rotatable thread block 5 can turn back and forth over 180°, and so that the rotation can be adjusted so that at each of its end-of-swivel positions the thread guide openings 14, is in thread block 5 are parallel to the longitudinal direction of the shed 10. Thus if the cloth is horizontal, as in FIGS. 1 and 2, the block 5 will be horizontal at each of these two positions.

The needle-shaped thread guide 6 is vertically directed and is solidly attached to the end 4 of arm 2, so that it moves up and down in front of the rotatable thread guide block 5, as shown in the figures. The needle-shaped thread guide 6 has at its top end a thread guide opening 26, through which the needle thread 27 is threaded.

Each of the arms 1 and 2 should preferably form part of a lever, as shown in FIGS. 1 and 2, while the drive mechanism 8 which controls the motion of these arms 1 and 2 consists mainly of a cam follower mechanism 28 and connecting rods 29 and 30, which are connected to the rear ends 31 and 32 respectively of the levers.

The drive mechanism 8 for the arms 1 and 2 may however consist of any other type of mechanism.

The operation of the device according to the invention is basically as follows: the ends 3 and 4 of the arms 1 and 2 move reciprocate to-and-fro in opposite directions under the action of the cam 33 of the cam follower mechanism 28, in such a way that he selvedge threads 16 and 17 and the needle thread 27 form a selvedge binding together with the weft threads as the latter are inserted one by one.

Clearly it is not necessary for the arms 1 and 2 to move simultaneously. In a variant of the invention (not shown in the figures), each of the connecting rods 29 and 30 may be attached to different cam follower mechanisms, driven by a pair of cams on a common shaft, instead of the common cam 33.

Figure 5:
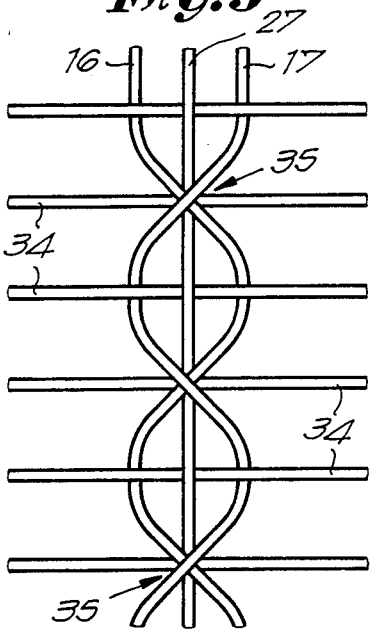
FIGS. 5 to 8 show a number of selvedge bindings which can be produced by the device according to the invention.
Figure 6:
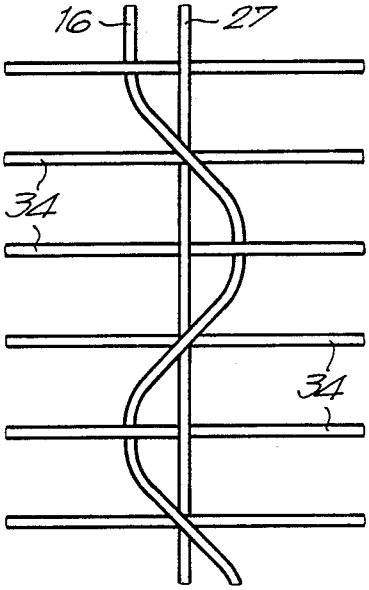

FIGS. 5 to 8 show various bindings which can be made with the device according to the invention. FIG. 5 shows a binding with two selvedge threads 16 and 17 and one needle thread 27. FIG. 6 shows a binding derived from the binding shown in FIG. 5, but in which only one selvedge thread 16 and one needle thread 27 is used.

Figure 7:
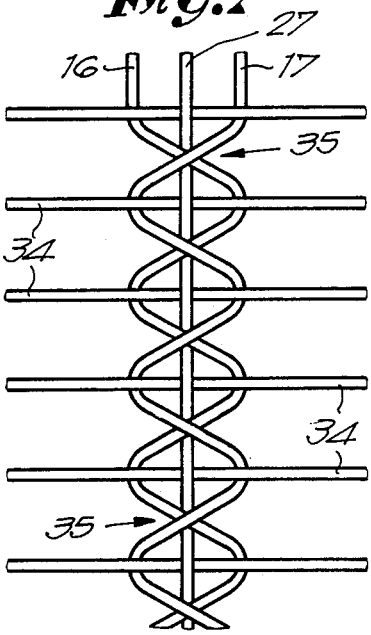
Figure 8:
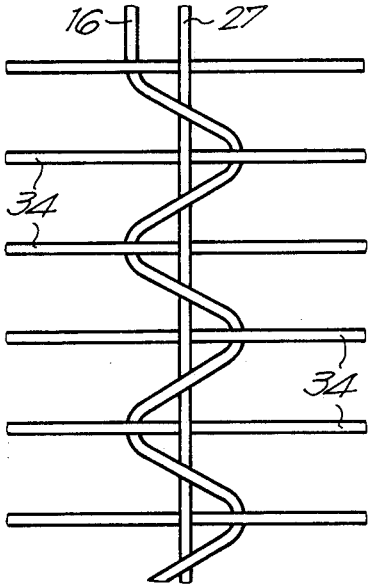

FIG. 7 shows another variation of the binding in FIG. 5, which gives a tighter binding. Fig. shows a binding derived from the one in FIG. 7, but in which only one selvedge thread 16 and one needle thread 27 is used.

To illustrate the operation of the device according to the invention, FIGS. 9 to 15 show, by way of example, the stages by which the binding in FIG. 5 is made, together with the successive positions of the arms 1 and 2.

Figure 9:
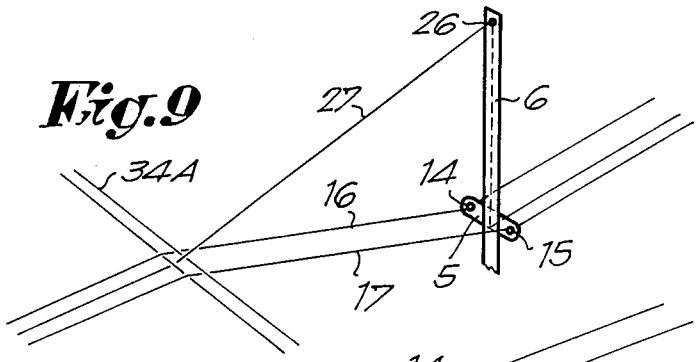
FIGS. 9 to 15 illustrate the operation of the device shown in FIG. 1, so as to obtain the binding shown in FIG. 5.
Figure 10:
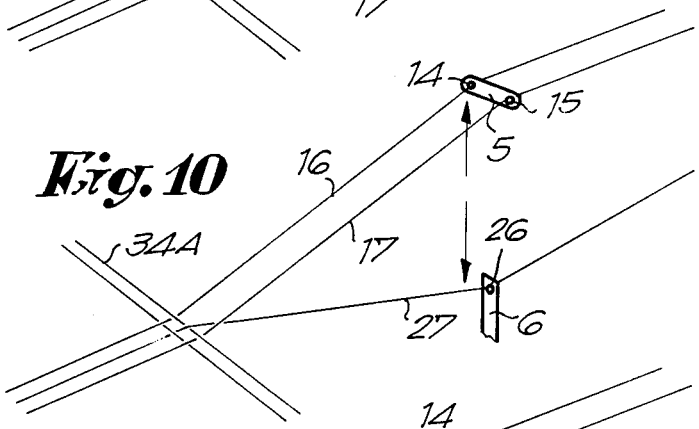
Figure 11:
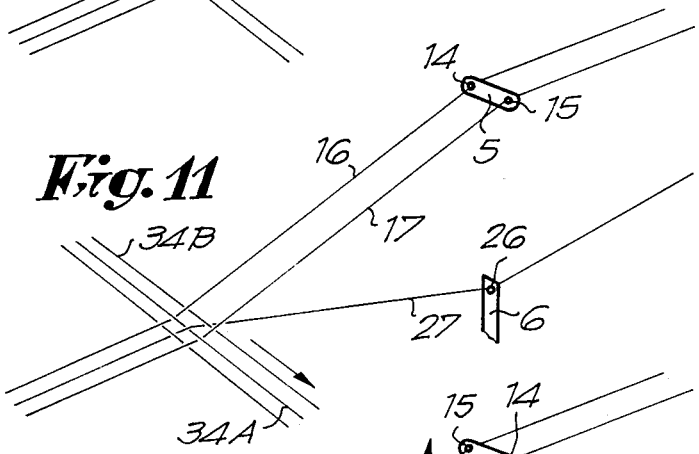
Figure 12:
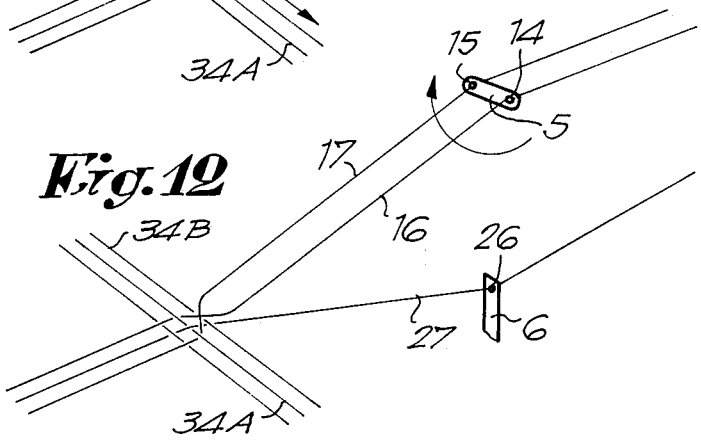

In FIG. 9, 34A represents the last warp thread inserted. As shown in FIG. 10, the position of the arms 1 and 2 is changed, with the thread guide block 5 raised and the needle-shaped thread guide 6 lowered, so that the warp thread 34A is bound in. The next warp thread 34B is then inserted, as shown in fig. 11, and then as shown in FIG. 12 the rotatable thread guide block 5 is turned over 180° (in this case clockwise), so that the selvedge threads 16 and 17 are crossed over the last-inserted weft thread 34B.

Figure 13:
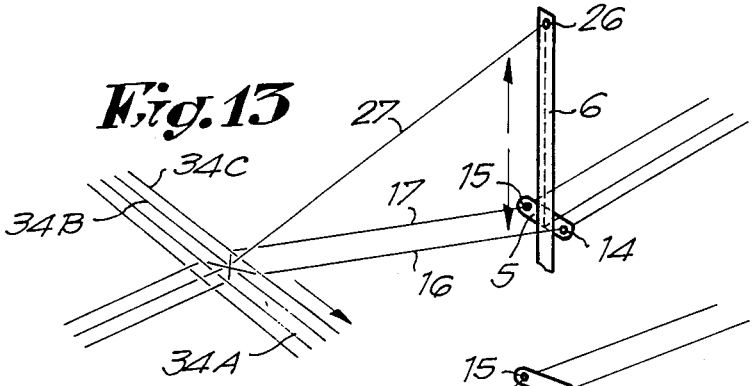
Figure 14:
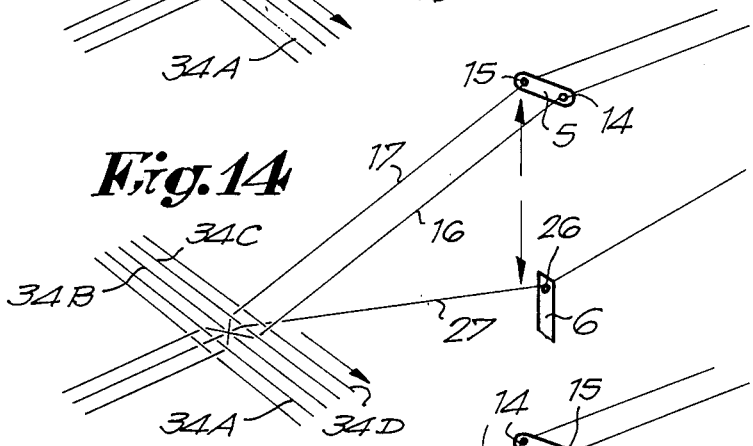

In the following step, as shown in FIG. 13, the position of the arms 1 and 2 changes over once more so that the warp thread 34B is bound in, and the next weft thread 34C is then inserted. This latest weft thread 34C is then bound in by changing the positions of the arms 1 and 2 once more, as shown in FIG. 14, and another weft thread 34D is inserted.

The rotatable thread guide block 5 is now turned back over 180°, so that the selvedge threads 16 and 7 are crossed over the weft thread 34D.

Figure 15:
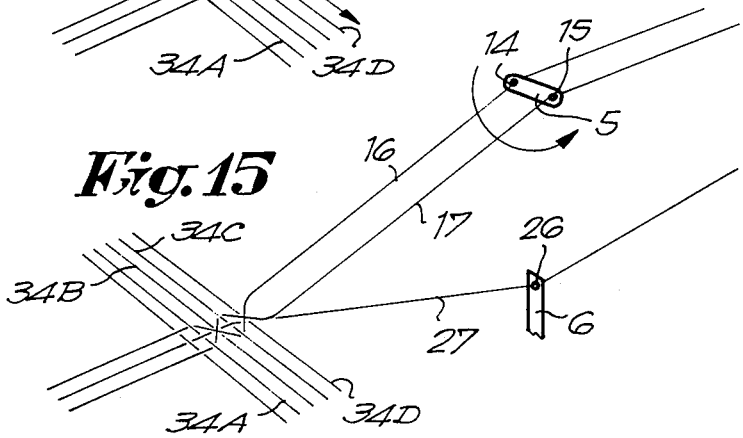

FIG. 15 shows clearly how by this process a binding is obtained as shown in FIG. 5. In making the binding, the movements of the arms 1 and 2 must obviously match the rate at which weft threads are inserted into the shed.

The binding shown in FIG. 7 can be obtained by changing the positions of the arms twice between each pick. Note that in this case the crossing threads 16 and 17 form part of the lower shed 12 while the needle thread 27 forms part of the upper shed 11. Between each pick the arms 1 and 2 change position, the rotatable thread guide block 5 turns over 180° and the arms 1 and 2 change over once more so as to return to their original position.

Clearly, the crossings 35 of the crossing threads 16 and 17 do not necessarily have to be on the upper side of the cloth in the way shown in FIGS. 5 and 7; the movements of the device components can also be arranged so that the crossings 35 are situated on the underside of the cloth.

It is also obvious that the relative positions of the arms 1 and 2 can be reversed, so that the needle-shaped thread guide 6 is pointing downwards.

Figure 16:
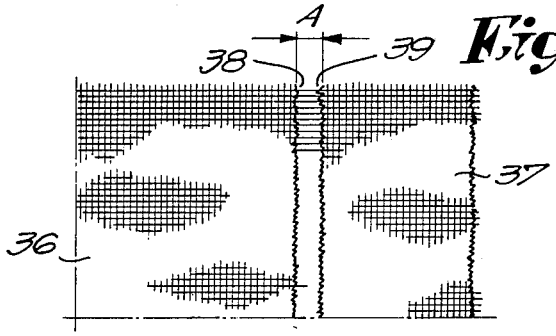
FIG. 16 shows schematically how a centre selvedge can be formed.

If as shown in FIG. 16 two pieces 36 and 37 are being woven over the whole weaving width, then two selvedge-forming devices may be mounted next to each other in order to make the selvedges 38 and 39. Clearly, using the device according to the invention in this way has the advantage that, since it takes up little width, the distance A can be kept to a minimum, thus making more efficient use of the weaving machine and keeping yarn waste to a minimum.

Figures 17, 18, 19:
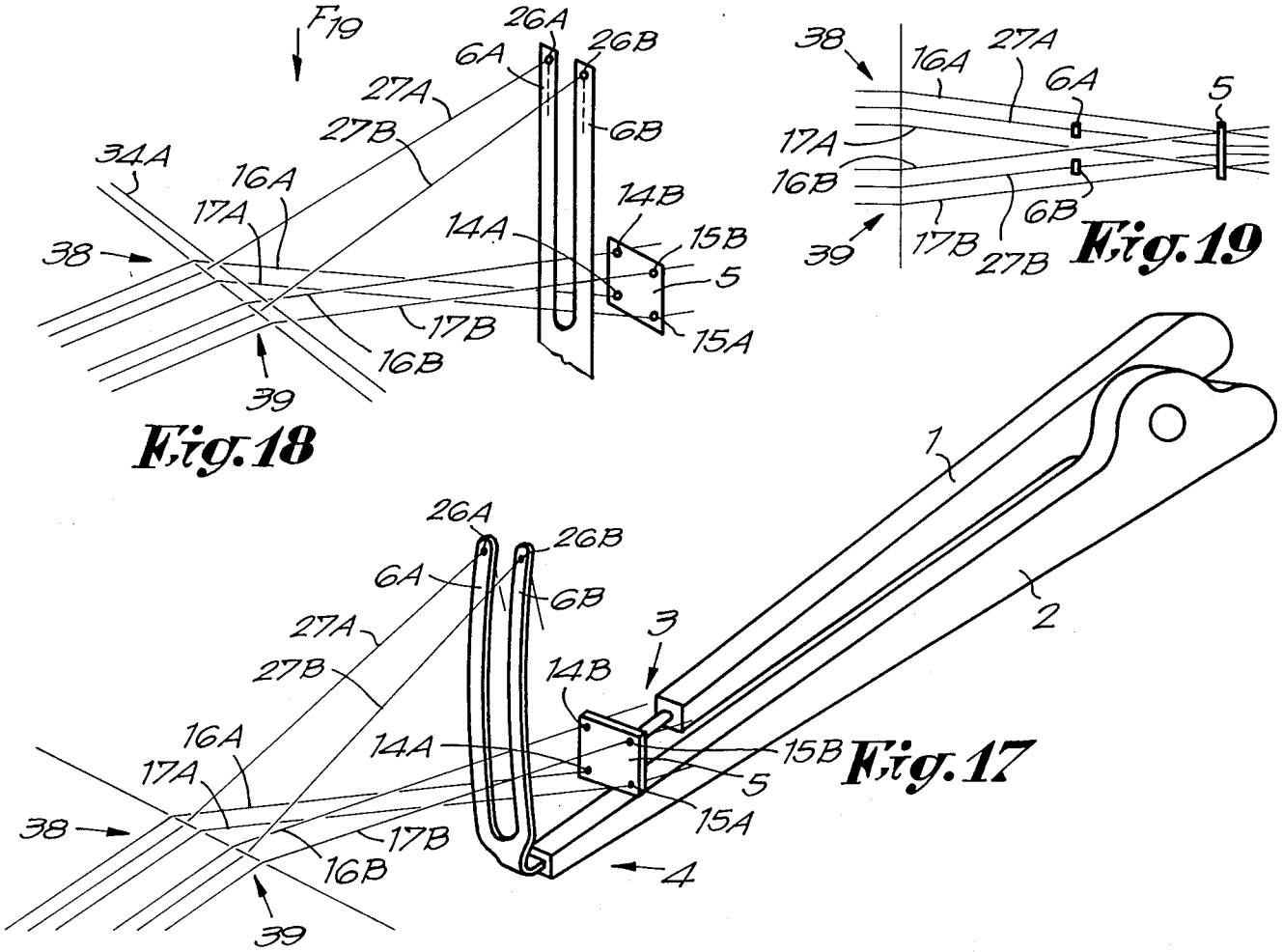
FIG. 17 shows a second embodiment of the invention, designed for making two selvedges.
FIGS. 18 to 25 illustrate the various stages of operation of the device shown in FIG. 17 so as to make two selvedges with the type of binding shown in FIG. 5.
Figure 20:
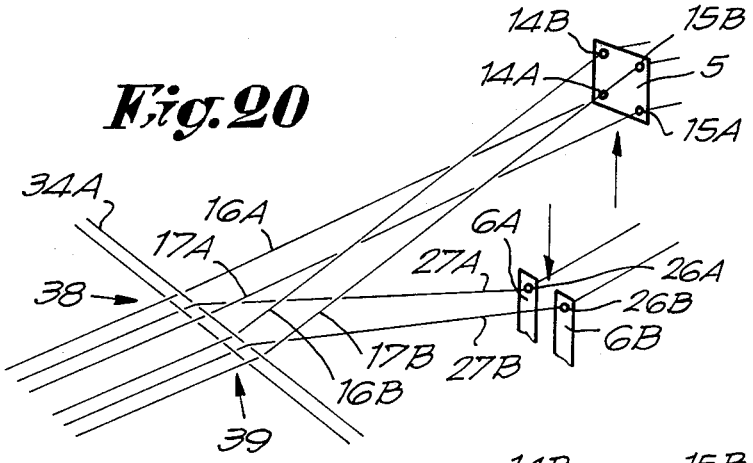
Figure 21:
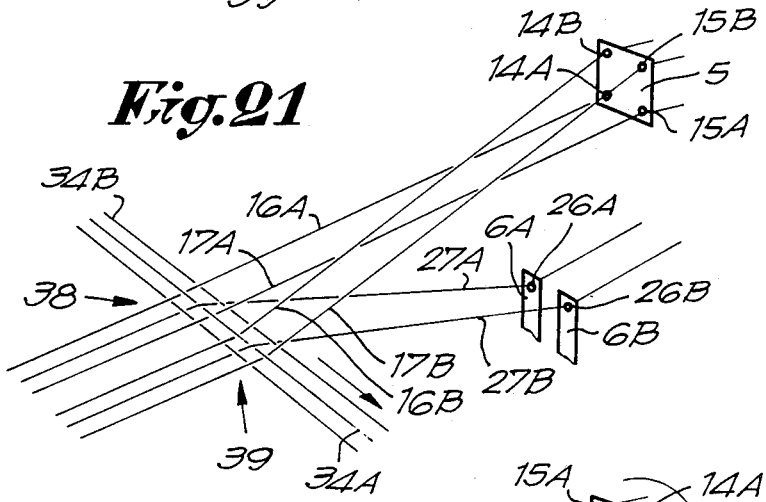
Figure 22:
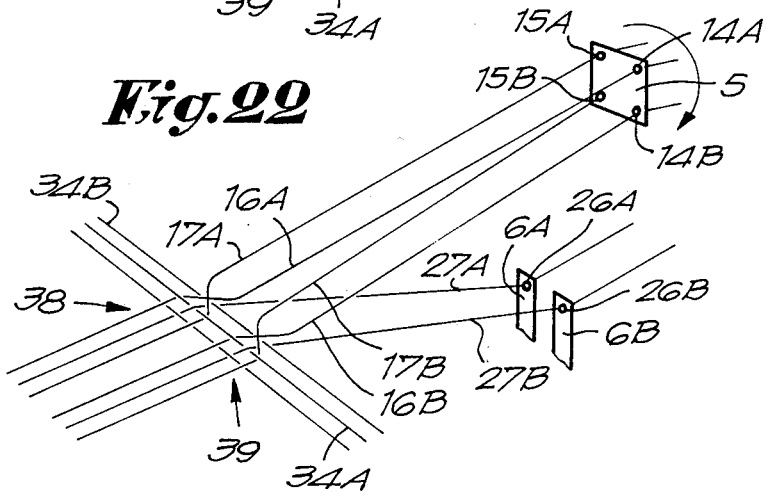
Figure 23:
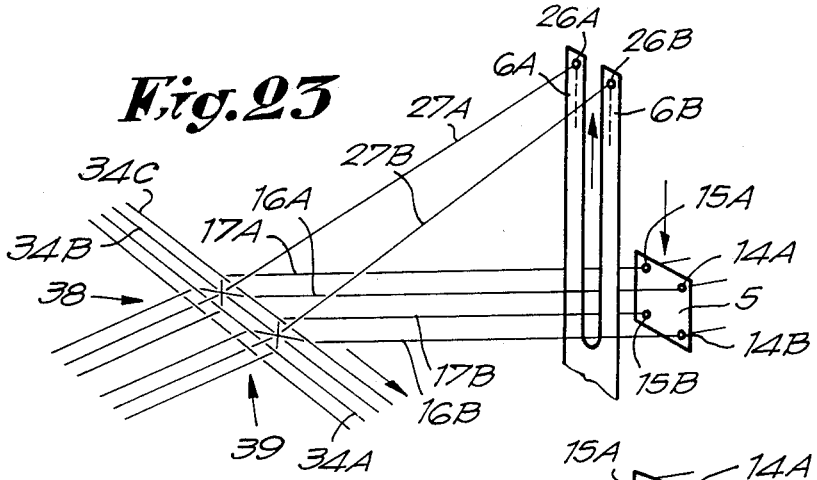
Figure 24:
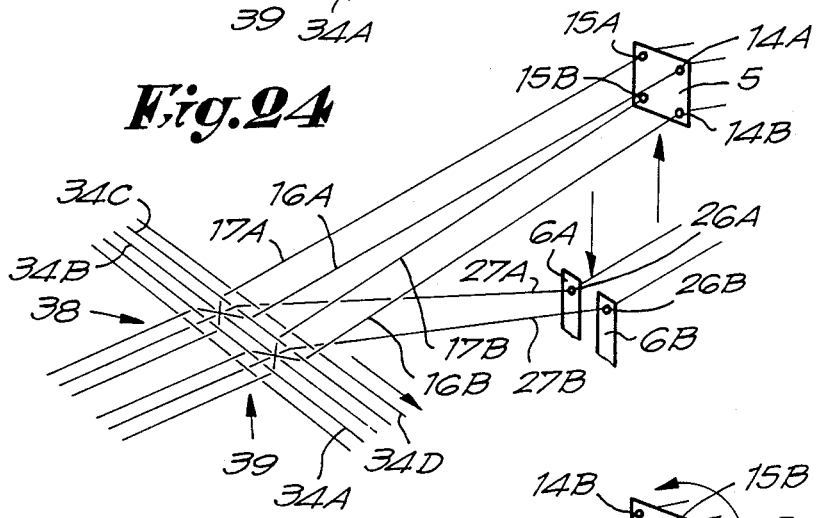
Figure 25:
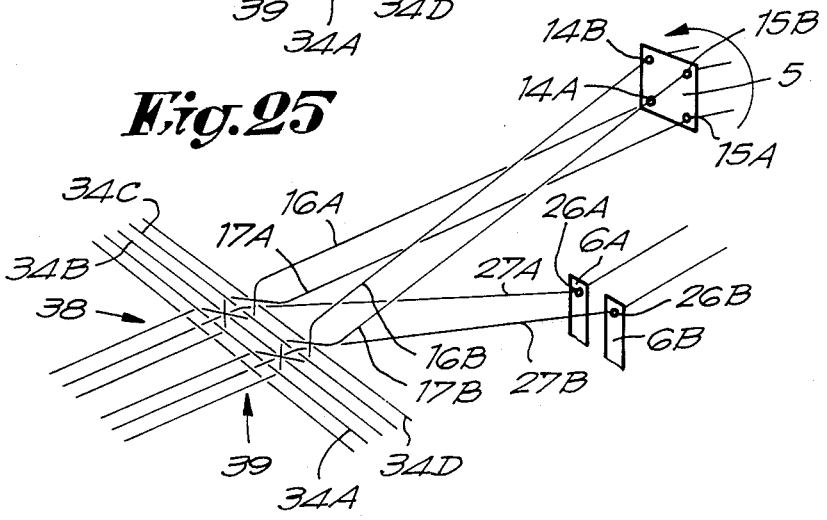

In order to keep the distance A in FIG. 16 to a strict minimum, a device according to the invention as shown in FIG. 17 may be used, which has one set of two arms 1 and 2 which can be used to form two selvedge bindings 38 and 39 next to each other. The various stages of operation of this device are shown in FIGS. 18 to 25; in this way, two selvedges as shown in FIG. 5 are formed. FIG. 19 is a top view of FIG. 18, while the remaining figures are analogous to FIGS. 9 to 15, but for a double selvedge. For the rest, all the other characteristics of the single configuration as shown in FIG. 1 apply equally to the device shown in FIG. 17, including the rotation over 180° of the rotatable thread guide block 5, the end portions, etc.

The present invention is in no way limited to the variants described by way of example and shown in the accompanying figures; on the contrary, such a device for forming a selvedge or selvedges according to the invention may be made in various forms and dimensions while still remaining within the scope of the invention.

We claim:

1. A device for forming at least one selvedge on woven cloth comprising:

a pair of arms arranged to pivot relative to each other about at least one pivot axis and having ends arranged to reciprocate as a result of pivotal arm movement, one of the arms having at its respective end a rotatable crossing thread guide block arranged to carry at least one selvedge crossing thread, and the other arm having at its respective end at least one needle thread guide arranged to carry a selvedge needle thread and to move in reciprocating motion in front of said thread guide block upon relative reciprocal movement of the ends of said arms;

a first drive means arranged to rotatably move said rotatable guide block;

a second drive means separate and independent of the first drive means arranged to cause relative pivotal movement of the arms relative to each other;

whereby rotational movement of said guide block can be controlled independently of reciprocal movement of said needle thread guide and said crossing thread guide block resulting from relative pivotal movement of the arms.

2. A device as claimed in claim 1, wherein said crossing thread guide block includes a pair of opposed selvedge crossing thread guide openings, and wherein said needle thread guide is needle shaped and includes a needle thread guide opening.

3. A device as claimed in claim 1, wherein said thread guide block includes two pair of selvedge thread guide openings arranged in a square pattern, and wherein said other arm has at its respective end a pair of needle thread guides each having a thread guide opening.

4. A device as claimed in either of claims 2 or 3, wherein the thread guide block is rotatable 180° to end positions whereat each pair of selvedge crossing thread guide openings lies in a line extending parallel with the longitudinal direction of the shed.

5. A device as claimed in claim 1, wherein said first drive means comprises an electromagnetically actuated linearly movable means and a motion converter means for converting linear movement of said linear movable means to rotary motion, and motion transmitting means for transmitting the converted rotary motion to said thread guide block.

6. A device as claimed in claim 13, wherein said motion transmitting means comprises a rod or cable extending at least in part along said one arm and connected to said rotatable thread guide block.

7. A device as claimed in any one of claims 1, 2, 3, 5 or 6, wherein said first and second arms comprise levers, and including cam follower means coupled to the levers for driving the levers in response to cam input motion.

8. The selvedge forming device as claimed in claim 1 wherein said arms are mounted for relative pivotal movement about a single common axis.

9. A selvedge forming device for an automated weaving loom comprising:

a pair of elongated support arms having end areas;

a selvedge crossing thread guide means carried at an end area of one of the support arms and arranged to be driven in rotation and including at least one crossing thread guide opening disposed laterally of the rotational axis;

a selvedge needle thread guide means carried at an end area of the other support arm and disposed in front of the crossing thread guide means;

said support arms arranged to be reciprocally moved relative to each other at least at their respective end areas carrying said needle and crossing thread guide means;

a first actuator means arranged to actuate the arms so that their end areas carrying the needle and crossing thread guide means reciprocally relative to each other in a plane extending transversely of the rotational axis of the crossing thread guide means;

a second actuating means separate and independent of the first drive means arranged to drive the crossing thread guide means in rotation;

said support arms comprising elongated elements each arranged to be pivoted about a pivot axis disposed towards an end of each arm opposite said end areas;

whereby the reciprocating and rotational motions of the needle and crossing thread guide means can be separately and independently controlled.

10. The selvedge forming device as claimed in claim 9, wherein said second actuating means includes a motion transmitting means connected to said crossing thread guide means, said motion transmitting means arranged at least in part to move with the respective support arm carrying said crossing thread guide means.

* * * * *